United States Patent [19]

Whirlow et al.

[11] 4,078,149

[45] Mar. 7, 1978

[54] VAPOR LIFT PUMP FOR VAPOR-COOLED TRANSFORMERS

[75] Inventors: Donald K. Whirlow, Murrysville, Pa.; John G. Aldworth; Garlington C. Wilburn, both of South Boston, Va.

[73] Assignee: Westinghouse Electric Corporation, Pittsburgh, Pa.

[21] Appl. No.: 731,392

[22] Filed: Oct. 12, 1976

[51] Int. Cl.[2] ..... H01F 27/18

[52] U.S. Cl. ..... 174/15 R; 165/105; 417/209

[58] Field of Search ..... 174/15 R, 14 R; 165/105; 237/60; 417/208, 209; 336/55, 57, 58, 61

[56] References Cited

U.S. PATENT DOCUMENTS

| | | | |
|---|---|---|---|
| 1,003,523 | 9/1911 | Seymour | 237/60 |
| 2,845,472 | 7/1958 | Narbutovskih | 174/15 R |
| 3,261,905 | 7/1966 | Allen | 417/209 X |
| 3,819,301 | 6/1974 | Jaster et al. | 417/209 |
| 3,834,835 | 9/1974 | Jaster et al. | 417/209 |
| 3,887,759 | 6/1975 | Staub et al. | 174/15 R |
| 4,011,535 | 3/1977 | Kosky et al. | 174/15 R X |

*Primary Examiner*—Arthur T. Grimley
*Attorney, Agent, or Firm*—William M. Hanlon, Jr.

[57] ABSTRACT

Electrical inductive apparatus, such as a transformer, cooled by a liquid dielectric having a boiling point within the normal operating temperature range of the apparatus. A vapor lift pump, with few or no moving parts, recirculates the liquid dielectric through a conduit which extends between a supply reservoir and a distribution point, by means of a pressure to velocity energy conversion provided by an orifice in a chamber located in the supply reservoir. The use of a vapor lift pump enables significant improvement in the reliability and power requirements of the apparatus.

7 Claims, 2 Drawing Figures

VAPOR LIFT PUMP FOR VAPOR-COOLED TRANSFORMERS

BACKGROUND OF THE INVENTION

1. Field of the Invention

This invention relates, in general, to electrical inductive apparatus, such as a transformer, and more particularly to electrical inductive apparatus where the cooling is achieved by vaporization of a liquid dielectric applied to the heat producing members. It is known to those skilled in the art, that electrical inductive apparatus can be cooled by the vaporization of two phase fluids which have a boiling point within the normal operating temperature range of the device.

In the aforementioned vaporization cooling system, the vapor produced subsequently condenses and can be reapplied to the heat producing members. However, in order to adequately cool the electrical apparatus and minimize the amount of fluid utilized in the system, the liquid dielectric must be recirculated. This poses reliability problems since the most common means of circulating liquid requires a conventional mechanical pump which contains many moving parts.

2. Description of the Prior Art

Several means have been developed which improve reliability by eliminating the mechanical pump. One is a vapor push pump disclosed in U.S. Pat. Nos. 3,819,301 and 3,834,835. According to this method, the vaporization of the liquid dielectric within a housing creates a vapor pressure which pushes an equal volume of liquid up a delivery conduit for subsequent application of the heat produced member. The vapor push pump still contains several moving parts which, although smaller in number than those in a conventional mechanical pump, could still cause reliability problems.

In another method, disclosed in U.S. Pat. No. 2,845,472, pressure differences within the cooling system cause the vapor, created by the vaporization of the liquid coolant on the heat producing member, to flow into a delivery conduit. While in this conduit, the vapor mixes with liquid dielectric thereby decreasing the average density of the liquid vapor mixture. The pressure differences, coupled with this low mixture density cause the liquid dielectric to flow up the conduit and thereby be applied to the heat producing member. While this method is highly reliable due to the absence of moving parts, a considerable amount of power is required to vaporize the liquid dielectric in sufficient quantities such that an adequate amount of coolant is applied to the heat producing member.

Therefore, it is desirable, and it is the purpose of this invention, to provide a pump which has no moving parts and which also requires less input energy than prior art vapor pumps for vapor cooled electrical inductive apparatus.

SUMMARY OF THE INVENTION

The present invention provides a novel means of recirculating the cooling fluid in electrical induction apparatus wherein such cooling system contains few or no moving parts. More specifically, when a volume of liquid dielectric is vaporized in a pressure vessel, the resultant vapor flows through a small orifice in the vessel which transforms the pressure energy of the vapor into velocity energy. The vapor transfers a large portion of this velocity energy to the liquid dielectric in a reservoir immediately surrounding the orifice, causing it to flow up a conduit, which is in close proximity to the orifice of the pressure vessel. The outlet opening of this conduit is affixed to a second reservoir of liquid dielectric which contains means for applying the coolant to the heat producing member.

The various features, advantages, and a fuller understanding of this invention will become apparent by referring to the following detailed description taken with the accompanying drawing.

DESCRIPTION OF THE PREFERRED EMBODIMENT

Figure 1:
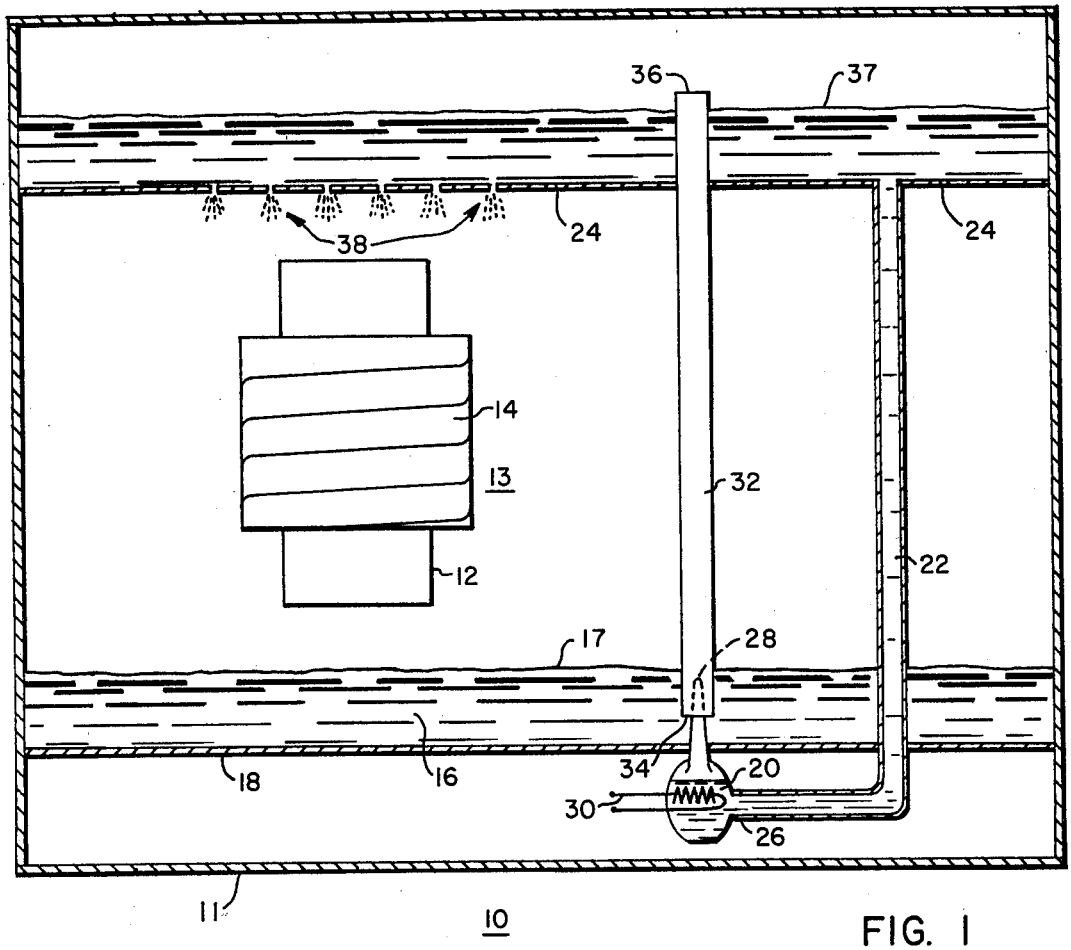
FIG. 1 is a schematic diagram of an embodiment of a vapor lift pump according to the teachings of this invention.

With reference to the drawing, FIG. 1 illustrates an electrical inductive apparatus 10, such as a transformer, reactor or the like, hereafter referred to as a transformer, constructed according to the teachings of this invention. The transformer 10 is comprised of a sealed case 11 surrounding a magnetic core and coil assembly 13 wherein electric windings 14 are disposed in inductive relation with a magnetic core 12. In order to simplify the drawing, the electric leads to the windings 14 and the associated electric bushings through the sealed case 11 are not shown.

The transformer 10 is cooled by applying a liquid dielectric over the heat producing member such as the magnetic core and coil assembly 13. The dielectric fluid should have its boiling point within the normal operating temperature range of the transformer 10 and, as known to those skilled in the art, is typically comprised of liquid fluorinated organic compounds. A more detailed list of such dielectric fluids for use as vaporizable coolants can be found by referring to U.S. Pat. No. 2,845,472. The vaporization of the dielectric fluid removes considerable heat from the magnetic core and coil assembly 13 and thereby cools the transformer 10.

However, the dielectric fluid must be recirculated to adequately cool the transformer 10 and minimize the amount of fluid required. To this end, the cooling system of this invention includes a volume of dielectric fluid 16 disposed in a first reservoir 18, a chamber, such as a pressure vessel or boiler 20, a first connecting means 22 and a second reservoir 24. The first connecting means 22, such as a conduit, is in fluid flow communication between the second or upper reservoir 24, situated above the magnetic core and coil assembly 13, and the inlet opening 26 of the chamber 20, thereby providing a supply of dielectric fluid to the chamber 20 and applying pressure to the liquid contained in the chamber 20 through a pressure head created by the height of fluid contained in the conduit 22 and the upper reservoir 24. A heat source 30, such as an electrical heating element, is disposed within the boiler 20. This heat source, upon energization, causes a portion of the dielectric fluid contained therein to vaporize; which further increases the pressure within the boiler 20. The vapor escapes from the boiler 20 through a conically-shaped outlet opening 28, such as an orifice or nozzle, whose narrow cross-section causes the velocity of the vapor flowing through it to be significantly increased. The nozzle 28 opens into the first or lower reservoir 18 and is submerged below the level 17 of liquid coolant 16 contained in the lower reservoir 18. The lower reservoir 18 is positioned below the magnetic core and coil assembly 13 and is constructed with adequate means to contain all the dielectric fluid that was not evaporated by the magnetic core and coil assembly 13 and also the condensate from the dielectric fluid that was evaporated. Positioned above and aligned with the nozzle 28 is a first opening of a second connecting means 32, such as a conduit, means which is in fluid communication between the first 18 and second reservoirs 24. The first opening or lower end 34 of the second conduit 32 is submerged below the level 17 of dielectric fluid contained in the lower reservoir 18 and surrounds the nozzle 28 such that the vapor flowing through the nozzle 28 will flow into the lower end 34 of the conduit 32. Further, the lower end 34 of the conduit 32 is suitably constructed as to also allow the dielectric fluid 16 contained in the lower reservoir 18 to be drawn into the conduit 32. As mentioned above, the pressure energy of the vapor in the boiler 20 is converted to kinetic velocity energy by the nozzle 28. A large portion of this velocity energy is transferred to the dielectric fluid 16 surrounding the nozzle 28 causing the fluid to flow or be lifted up the conduit 32 by the fast moving vapor stream. The liquid-vapor mixture flows into the upper reservoir 24 through a second or upper opening 36 of the conduit 32 which is in fluid flow communication with the upper reservoir 24.

Upon reaching the upper reservoir 24, the liquid dielectric will establish a level 37 which will increase the pressure head in the conduit 22, thereby maintaining the operation of the cooling system due to the increased pressure in the boiler 20. Further, a portion of the dielectric fluid will flow through a plurality of openings 38 in the upper reservoir 24 onto the magnetic core and coil assembly 13 thereby cooling the transformer.

It should be noted that the velocity of the vapor flowing through the nozzle 28 moves more dielectric fluid to the upper reservoir 24 and then onto the heat producing member, than pumps constructed according to the prior art. As a result, less power is required by the heating element 30 to supply a sufficient quantity of dielectric fluid to adequately cool the magnetic core and coil assembly 13.

To further improve system efficiency and reduce the power requirements of the heat source 30, the boiler 20 contains adequate insulating means so as to maintain the temperature of the dielectric fluid contained therein at or near its boiling point.

Figure 2:
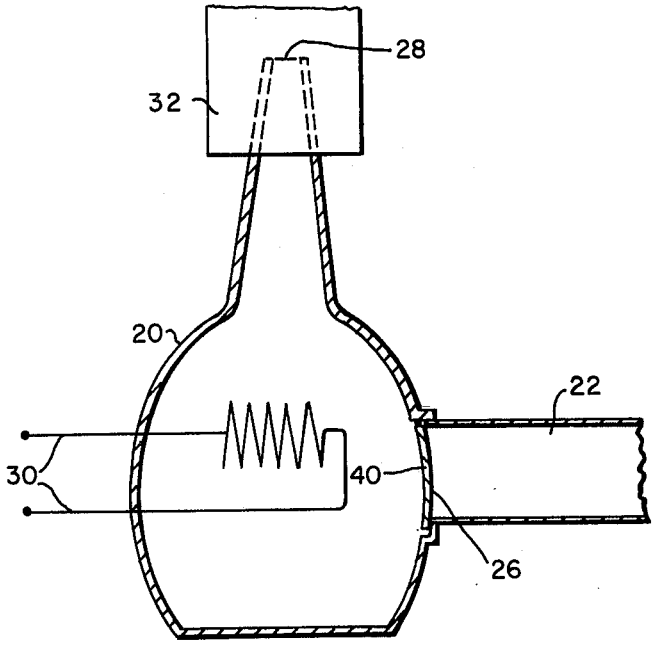
FIG. 2 is a detailed schematic diagram of a portion of FIG. 1 showing another embodiment of a vapor lift pump according to the teachings of this invention.

Referring to the drawing, FIG. 2 illustrates another embodiment of this invention in which all like components of FIGS. 1 and 2 have been given the same reference numbers. The main distinction between FIGS. 1 and 2 is the addition of a check valve 40 in conduit 22.

In the embodiment shown in FIG. 2, the check valve 40 will open, thereby allowing flow of dielectric fluid into the chamber 20, only when the pressure in the conduit 22 is higher than the pressure within the chamber 20. In normal operation, the following sequence will occur. The pressure within the conduit 22 will initially be higher than the pressure within the chamber 20 due to the pressure head of the liquid in the conduit 22 and the upper reservoir 24. Therefore, the check valve 40 will be open and dielectric fluid will flow into the chamber 20 submerging the heating element 30. The electrical heating element 30 will heat up the dielectric fluid thereby increasing the pressure in the boiler 20. When the pressure in the boiler 20 equals or exceeds the pressure in the conduit 22, the check valve 40 will close thereby shutting off the flow of liquid into the boiler 20 and causing a further buildup of pressure within the boiler 20. The additional pressure due to the closing of the check valve 40 will cause the vapor to flow from the boiler 20 with added velocity thereby increasing the flow of dielectric fluid into the conduit 32 and further decreasing the amount of heat energy required. As the vaporized coolant flows through the nozzle 28 the liquid level in the boiler 20, will fall until the heating element 30 is no longer submerged. At this point, the pressure in the boiler 20 will decrease rapidly until the pressure head in the conduit 22 exceeds the pressure in the boiler 20; at which time the check valve 40 will open and refill the boiler 20 with liquid thereby causing the cycle to repeat.

It will be apparent to one skilled in the art, that what has been disclosed in a vapor lift pump with few or no moving parts which utilizes the velocity energy of vapor flowing through a nozzle to efficiently and reliably draw dielectric fluid up a conduit for application to a heat producing electrical induction apparatus. Furthermore, in a vapor lift pump constructed according to the teachings of this invention, less input power is required to vaporize the dielectric fluid in sufficient quantities to adequately cool the electrical inductive apparatus.

What is claimed is:

1. Electrical inductive apparatus comprising:

a casing;

a heat-producing member disposed within said casing;

means defining a first reservoir within said casing disposed below said heat-producing member;

means defining a second reservoir within said casing disposed above said heat-producing member;

a dielectric fluid vaporizable within the normal operating temperature range of said heat-producing member disposed in said first and second reservoir means;

means defining a chamber having inlet and outlet openings;

first connecting means having first and second openings disposed in fluid flow communication between said inlet opening of said chamber and said second reservoir means, respectively, to provide dielectric fluid to said chamber;

means for vaporizing a portion of said dielectric fluid contained in said chamber; and second connecting means having first and second openings disposed in fluid flow communication between said first and second reservoir means, respectively;

said chamber being disposed with its said outlet opening below the level of said dielectric fluid in said first reservoir means, said outlet opening further being disposed within and surrounded by said first opening of said second connecting means to allow said vaporized dielectric fluid to flow from said outlet opening into said second connecting means wherein the high velocity of said vaporized dielectric fluid flowing therethrough lifts a portion of said dielectric fluid in said first reservoir means through said first opening of said second connecting means and into said second connecting means and thence into said second reservoir means;

said second reservoir means including means for applying said dielectric fluid to said heat-producing member to effect cooling thereof.

2. The electrical inductive apparatus of claim 1 wherein the means for vaporizing is an electrical heating element disposed within the chamber.

3. The electrical inductive apparatus of claim 1 wherein the outlet opening of the chamber has a frustum configuration.

4. The electrical inductive apparatus of claim 1 wherein the means for applying dielectric fluid includes the second reservoir means having a plurality of openings therein.

5. The electrical inductive apparatus of claim 1 further including valve means, disposed to block dielectric fluid from entering the chamber when the pressure within said chamber exceeds the pressure within the first connecting means, for increasing the pressure within said chamber which causes vaporized dielectric fluid to flow from said chamber with added velocity.

6. The electrical inductive apparatus of claim 1 further including insulating means associated with the chamber for keeping the dielectric fluid contained therein at or near its boiling point.

7. Electrical inductive apparatus comprising:

a sealed casing;

a heat-producing member disposed within said casing;

means defining a first reservoir within said casing disposed below said heat-producing member;

means defining a second reservoir within said casing disposed above said heat-producing member;

a dielectric fluid vaporizable within the normal operating temperature range of said heating-producing member disposed in said first and second reservoirs;

means defining a chamber having inlet and outlet openings; said outlet opening generally having a frustum configuration;

first connecting means having first and second openings disposed in fluid flow communication between said inlet opening of said chamber and said second reservoir to provide said dielectric fluid to said chamber;

an electrical heating element disposed within said chamber to vaporize a portion of said dielectric fluid contained therein; and second connecting means having first and second openings disposed in fluid flow communication between said first and second reservoirs, respectively;

said chamber being disposed with its said outlet opening below the level of said dielectric fluid in said first reservoir; said outlet opening further being disposed within and surrounded by said first opening of said second connecting means to allow said vaporized dielectric fluid to flow from said outlet opening into said second connecting means wherein the high velocity of said vaporized dielectric fluid flowing therethrough lifts a portion of said dielectric fluid in said first reservoir through said first opening of said second connecting means and into said second connecting means and thence into said second reservoir;

said second reservoir means including a plurality of opening therein for applying said dielectric fluid to said heat-producing member to effect cooling thereof.

* * * * *